US005207434A

United States Patent [19]

Oudekerk

[11] Patent Number: 5,207,434

[45] Date of Patent: May 4, 1993

[54] THROWING DART WITH COLLAPSIBLE TAIL PORTION

[76] Inventor: Timothy K. Oudekerk, 8022 Kelly Rd., Winnebago, Ill. 61088

[21] Appl. No.: 909,043

[22] Filed: Jul. 6, 1992

[51] Int. Cl.[5] ..... A63B 65/02

[52] U.S. Cl. ..... 273/423

[58] Field of Search ..... 273/416, 420, 423

[56] References Cited

U.S. PATENT DOCUMENTS

| | | | |
|---|---|---|---|
| 3,433,210 | 3/1969 | Schnitz | 124/12 |
| 3,454,278 | 7/1969 | Cooper et al. | 273/423 |
| 4,488,728 | 12/1984 | Humphrey | 273/423 |
| 4,583,745 | 4/1986 | Ladner | 273/423 |
| 4,770,423 | 9/1988 | Pinske | 273/423 X |
| 4,842,285 | 6/1989 | Farler | 273/423 X |
| 4,886,280 | 12/1989 | Bottelsen | 273/423 |

FOREIGN PATENT DOCUMENTS

| | | | |
|---|---|---|---|
| 591882 | 9/1947 | United Kingdom | 273/423 |
| 594574 | 11/1947 | United Kingdom | 273/420 |
| 2227426 | 8/1990 | United Kingdom | 273/423 |

*Primary Examiner*—Paul E. Shapiro
*Attorney, Agent, or Firm*—Stanley E. Anderson

[57] ABSTRACT

A throwing dart provided with a tail portion which collapses into a smaller cross-sectional area to reduce interference with subsequently thrown darts. The tail portion includes a stem portion having an elongated cylindrical shaft provided with a disk-shaped cam member. A slotted tubular sleeve is slidably and rotatably affixed to the shaft, the slots opening to the axially rearward end of the sleeve. A shaped flight or vane is fitted to each slot and flexibly retained therein by a resilient holding ring which retains the forward ends of the flights to the sleeve. In operation, the tail portion is cocked by sliding the sleeve and flight assembly in a rearward direction such that the cam urges the flights into an extended, fanned position. When the dart is thrown and impacts the game board, the tail portion moves forwardly due to inertia, and the cam is received in angled recesses in the flights to permit them to retract toward the longitudinal axis of the dart. A deflector for deflecting away subsequently thrown darts is affixed to the rearward end of the stem portion.

20 Claims, 1 Drawing Sheet

THROWING DART WITH COLLAPSIBLE TAIL PORTION

FIELD OF THE INVENTION

The present invention relates to the game of darts, and more particularly to a collapsible tail portion for a throwing dart which reduces interference with subsequently thrown darts.

BACKGROUND OF THE INVENTION

Various dartboard games utilize a throwing dart of the type having a shaped front end that pierces and is retained by the game board and a tail portion having a plurality of flights (also known as vanes, fins, or feathers) that stabilize and provide consistent flight characteristics of the dart after it has left the thrower's hand en route to the game board. The shaped front end may be either blunt or sharpened to correspond with the particular type of game board in use. The front end and tail portion are affixed to opposite ends of a weighted dart body or barrel.

The flights of the tail portions of many throwing darts are typically extended in a radially outward orientation relative to the longitudinal axis of the dart, the degree of extension being functionally related to the desired flight characteristics of the dart. However, the extended flights present a cross-sectional area somewhat greater than the cross-sectional area of the dart body. The extended flights of a dart already imbedded in or in place on the game board may interfere with the target area adjacent that dart, such that subsequently thrown darts strike and are deflected by the flights of the in-place dart, thereby preventing subsequently thrown darts from piercing and/or being retained on the game board. This problem is magnified when a plurality of previously thrown darts are clustered in high-point-value zones of the game board. Subsequently thrown darts may be deflected in the aforementioned manner or may dislodge one or more of the previously thrown darts in place on the game board.

One approach to solving this interference problem is to provide a dart with a body that breaks away from a magnetically-held point when the point impacts and pierces the game board, as described in U.S. Pat. No. 4,109,915. Another approach is to provide a dart having flexible flights that move from an operable fanned position during throwing to a stored collapsed position when the point impacts the game board as described in British Patent No. 594,574 and U.K. Patent Application No. 2227426.

Another problem is the lodging of the points or front end portions of subsequently thrown darts in the rearwardly opening recesses of the tail portions of previously thrown darts. The resulting impact, jamming, and subsequent separation often causes damage to both darts.

SUMMARY AND OBJECTS OF THE INVENTION

Accordingly, it is an object of the present invention to provide a throwing dart with a collapsible tail portion for reducing the interference between in-place darts on a dartboard and subsequently thrown darts.

It is another object of the present invention to provide a throwing dart with collapsible flights which are positioned in an aerodynamic extended position during throwing and collapse into a retracted position on impact with the game board.

It is a further object of the present invention to provide a throwing dart having a device for preventing subsequently thrown darts from lodging in the tail portions of in-place darts.

The present invention is directed particularly to a tail portion of a throwing dart having a plurality of flights which collapse into a retracted position when the dart impacts with the game board. The tail portion includes a stem portion having an elongated cylindrical shaft coaxially aligned with and removably affixed to the dart body. The cylindrical shaft is provided with a disk-shaped cam member at its rearward end. An integrally formed tubular sleeve, comprised of first and second cylindrical portions connected with a conical portion, is slidably and rotatably affixed to the cylindrical shaft. The first portion of the tubular sleeve is provided with four equiangularly spaced apart slots which open to the rearward end of the sleeve. The four slots thus define four rearwardly extending cantilevered sections of the first portion of the sleeve. A circumferential groove is formed in the first portion adjacent the forward end thereof and intersects the four slots.

Four flights, each having a shaped outer edge tapering to a rounded trailing edge, are arranged in the slots of the first portion of the sleeve. The flights are fabricated from semi-rigid plastic sheet or other suitable material. The flights are movable within the slots in radial planes with respect to the axis of the tail portion. Each flight has a finger integrally formed at the forward end of the flight which hooks over the conical portion of the tubular sleeve. A transverse groove is formed in the outer edge of each flight in a plane coinciding with the circumferential groove of the sleeve. A resilient holding ring is engaged with the transverse grooves in the flights and the circumferential groove in the sleeve. An angled recess with a cam follower edge is formed in the radially inner edge of each flight, the recesses being sized and positioned to receive the disk-shaped cam member when the tail portion is in a retracted or collapsed position. A notch is formed in the flight also along the radially inner edge thereof between the finger and the angled recess for receiving the cam member when the tail portion is in a cocked position.

A dart deflector is affixed to the rearward face of the cam member by a connecting rod portion which extends axially rearwardly beyond the trailing edges of the flights. The deflector has a diameter equal to or greater in size than the diameter of the sleeve. The deflector can be sized and weighted as desired to obtain optimum dart balance.

To cock the dart, the assembled tail portion is manually shifted axially rearwardly along the cylindrical shaft so that the cam member engages the cam follower edge and causes the flights to pivot radially outwardly about the fingers against the bias of the resilient holding ring until the cam member engages in the notches formed in the flights. Simultaneously, the four sections of the first sleeve portion are splayed slightly radially outwardly by the periphery of the cam member, thereby reducing or eliminating friction between the flights and the edges of the slots. When the flights of the tail portion are in their outermost extended or fanned position, the dart is ready to be thrown. When the dart is thrown and impacts the game board, the tail portion is shifted by inertia axially forwardly along the cylindrical shaft so that the cam member disengages from the notches and moves axially rearwardly relative to the flights. As the cam member contacts and follows the cam follower edges of the flights, it is simultaneously received by the angled recesses until the flights are fully retracted and the tail portion is fully collapsed. The radially inward edges of the flights enclose the connecting rod portion of the deflector, which covers part of the trailing edges of the retracted flights, as well as the open rearward end of the sleeve.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
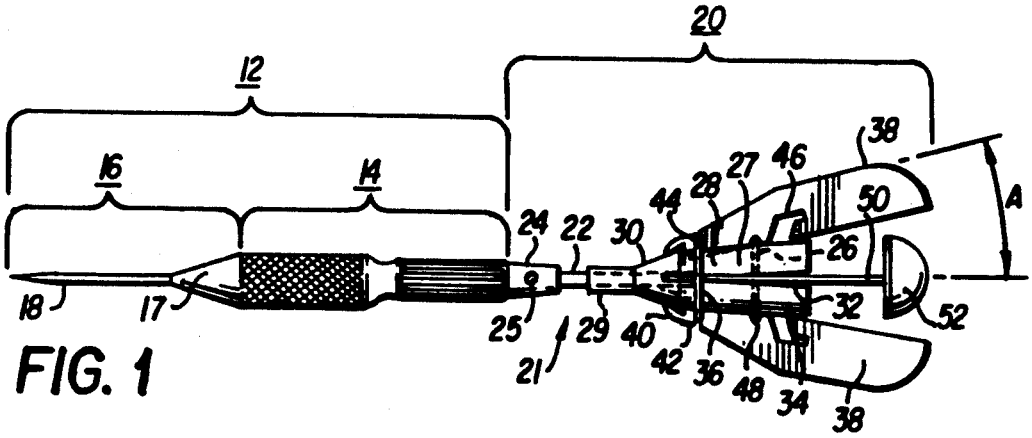
FIG. 1 is a side elevation view of the throwing dart of the present invention, showing the tail portion in a fully extended or cocked position.

Referring now in detail to the drawings wherein like parts are designated by like reference numerals throughout, there is illustrated in FIG. 1 a throwing dart of the invention which is designated generally by reference numeral 10. The dart 10 comprises an elongated cylindrical body or barrel 12 of conventional design and composition which includes a knurled gripping portion 14, a tip portion 16 integrally formed with or threadably affixed to the gripping portion 14, and a tail portion 20. The tip portion 16 comprises a conical portion 17 with a blunt plastic point 18 shaped to pierce and be retained by a game board (not shown). If the tip portion 16 is removably affixed to the gripping portion 14, e.g., by a threaded connection, the blunt point 18 may be readily exchanged for a sharpened steel point (not shown) or any other type of point compatible with the retention surface and structure of a particular game board.

Figure 4:
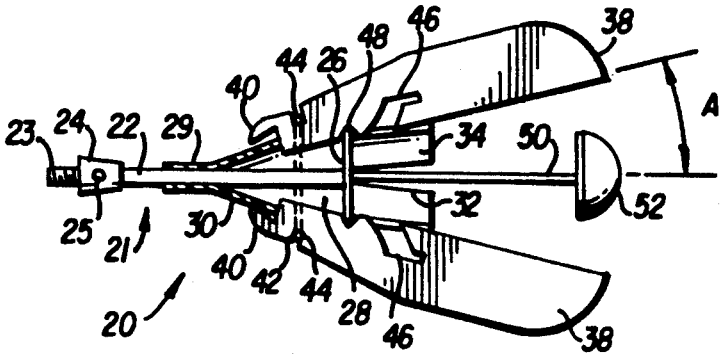
FIG. 4 is a side elevation view, partly in cross-section, of the tail portion of FIG. 1, showing the tail portion in a fully cocked position.

The collapsible tail portion 20 of the present invention is removably affixed to the rearward end of the dart barrel 12, preferably by a threaded portion 23 (FIG. 4). The tail portion 20 includes a stem portion 21 comprising an elongated cylindrical shaft 22 affixed to a conical portion 24 and having a disk-shaped cam member 26 at the rearward end thereof. The shaft 22 is affixed in an axial bore (not shown) in the conical portion 24 by an interference fit or other suitable connection. A transverse through bore 25 may be provided in the conical portion 24 through which a rod may be inserted for tightening the threaded connection 23 between the tail portion 20 and the barrel 12. The cylindrical shaft 22, which may be fabricated from a metal, such as aluminum, or from another rigid material, is in coaxial alignment with the longitudinal axis of the dart 10 in its installed condition.

A dart deflector 52 having a rearwardly facing conical or convex surface is affixed to the rearward face of the cam member 26 by a connecting rod. Rod 50 is preferably threaded into an axial bore in the cam member 26 and shaft 22. The deflector 52 may be molded of a plastic material, such as nylon, and has a diameter at its base at least equal to the diameter of the first portion 28 of the sleeve 27. Rod 50 is fabricated from 0025 inch diameter tempered steel wire and, together with the deflector 52, is sufficiently resilient to absorb the impact of subsequently thrown darts and to deflect those darts away from the rearward opening of the first portion 28 of the sleeve to prevent damage thereto. The deflector 52 can be sized and weighted, or fabricated from different materials as desired to obtain optimum dart balance and flight characteristics.

The tail portion 20 further comprises a slotted plastic tubular sleeve 27, including a first cylindrical portion 28 and a second cylindrical portion 29 connected with a conical portion 30 and being slidably and rotatably affixed to the shaft 22. Optionally, the second portion 29 may be installed on the shaft 22 independently of the first portion 28 and conical portion 30. The second portion 29 functions as a guide and spacer to prevent possible movement of the tail portion 20 too far forwardly on the shaft 22.

Figure 2:
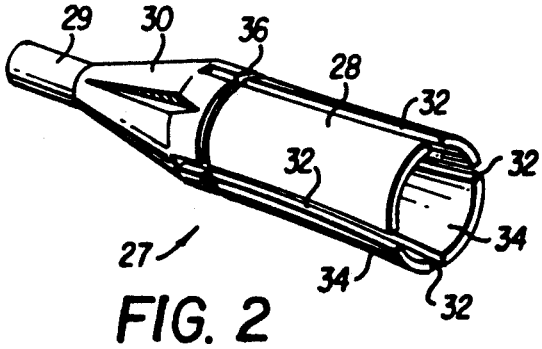
FIG. 2 is a perspective view of the tubular sleeve of the tail portion shown in FIG. 1.

Now referring to FIG. 2 which illustrates the sleeve 27 in detail, the first sleeve portion 28 is provided with a four equiangularly spaced apart slots 32 which are open toward the rearward end of the first portion 28 and divide the first portion into four cantilevered sections 34. According to the preferred embodiment of the present invention, the first portion 28 is provided with four slots 32 spaced 90 degrees apart, although a lesser or greater number of slots may be used, e.g., three slots 120 degrees apart or six slots 60 degrees apart. A circumferential groove 36 is formed in the periphery of the first portion 28 adjacent the forward end thereof for a purpose to be described.

Figure 3:
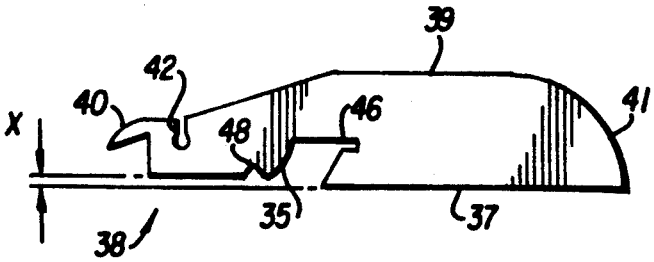
FIG. 3 is a side elevation view of one of the flights of the tail portion of the present invention.

Referring now to FIG. 3, each of the flights 38 has a shaped outer edge 39 tapering to a rounded trailing edge 41. The flights 38 are fabricated from semi-rigid plastic sheet or the like. The forward end of each flight 38 is provided with a finger 40 angled downwardly toward the inner edge 37. A transverse groove 42 is formed in the outer edge 39 of each flight 38. A resilient holding ring 44, such as an 0-ring or elastic band, is engaged with the transverse grooves 42 and the circumferential groove 36 (FIG. 1) to bias the flights 38 in a radially inward direction against the sleeve 27 during all stages of extension and retraction of the tail portion 20, as will be more fully described below. According to the described embodiment, the plane of the transverse grooves 42 of the installed flights 38 coincides with the circumferential groove 36 (FIG. 1) of the first portion 28. This assembly 20 allows for the ready removal and replacement of individual flights 38 from the sleeve 27 and resilient holding ring 44 as the need arises.

An angled recess 46 is formed on the radially inner edge 37 of each flight 38, the recess 46 being sized to receive the cam member 26 when the tail portion 20 is in the retracted or collapsed position. The forward edge of the recess 46 comprises a cam follower edge 35. A notch or detent 48 is also formed along the radially inner edge 37 between the finger 40 and the angled recess 46 for receiving the cam member 26 when the tail portion 20 is in the cocked position. The inner edge 37 is relieved by a dimension X at the forward end thereof to accommodate the diameter of the shaft 22.

Referring now to FIGS. 1 and 4, the dart 10 is placed into a fully cocked position by grasping the conical portion 30 with the fingers and manually shifting or sliding the assembled tail portion 20 axially rearwardly along the cylindrical shaft 22. This causes the cam member 26 to engage the cam follower edge 35 of each flight 38 and as the cam member 26 travels along the edges 35, the flights 38 are pivoted outwardly toward their cocked or extended position about pivot axes formed at the contact points between the fingers 40 and the conical portion 30. Simultaneously, the periphery of the cam member 26 engages the inner surfaces of the cantilevered sections 34 and causes them to splay slightly radially outwardly, thereby reducing or eliminating a source of friction between the slots 32 and the planar surfaces of the flights 38 during subsequent operation. Continued rearward shifting of the tail portion 20 causes the periphery of the cam member 26 to engage in the notches 48 with the flights 38 disposed at an angle A with respect to the axis of the dart 10. The flights 38 of the tail portion 20 are now in their cocked or extended position and the dart 10 is ready to be thrown.

Figure 5:
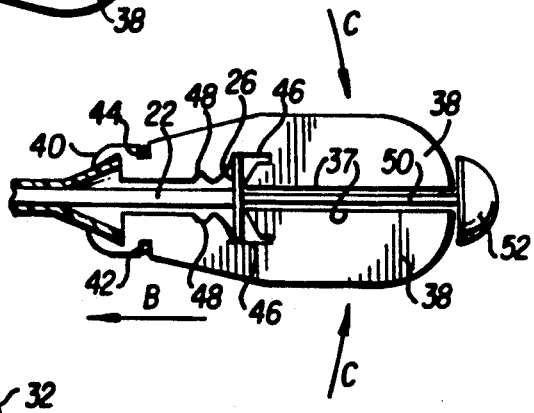
FIG. 5 is a side elevation view, partly in cross-section, of the tail portion of FIG. showing the tail portion in a retracted or collapsed position.

According to FIG. 5, when the dart 10 is thrown and impacts the game board (not shown), inertia causes the tail portion 20 to be shifted axially forwardly relative to the cylindrical shaft 22 in the direction of arrow B thereby causing the cam member 26 to disengage from the notche 48 and shift axially rearwardly relative to the flights 38. The resilient holding ring 44 urges the flights 38 radially inwardly toward the sleeve 27 to maintain the fingers 40 in a pivoting relationship about the conical portion 30 during extension and retraction of the tail portion 20. As the cam member 26 follows the cam follower edges 35, the cam 26 is simultaneously received in the angled recesses 46 of each flight 38 until the flights have fully retracted in the direction of arrows C toward the longitudinal axis of the dart The radially inward edges 37 of the flights 38 enclose the connecting rod portion 50 of the deflector 52, which covers part of the trailing edges 41 of the retracted flights 38.

From the foregoing description it will be apparent to those skilled in the art that the present invention advantageously provides a dart with a tail portion having flights capable of being extended to a maximum radial position to improve the flight characteristics and accuracy of the dart, which flights can be automatically retracted by inertial forces to a collapsed position upon target impact so as to minimize interference with subsequently thrown darts. The invention also advantageously provides a deflector means for preventing damage to the tail portion of the dart from subsequently thrown darts which may inadvertently impact the tail portion of the dart.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A throwing dart comprising a dart body having an axis, a tail portion connected to said body and comprising a plurality of flights movable axially relative to said dart body, means connected to said flights for moving said flights from radially retracted positions to radially outwardly extended positions relative to said axis in response to movement of said flights axially away from said dart body, means for biasing said flights toward said radially retracted positions, means connected to said flights for retaining said flights in said radially outwardly extended positions during the flight of said dart and means responsive to the impact of said dart with a target for releasing said flights from said radially outwardly extended positions such that said biasing means moves said flights to and retains said flights in said radially retracted positions.

2. The throwing dart of claim 1, wherein said tail portion comprises a stem portion including a shaft, said flight extending means comprising a cam member mounted to said shaft and a recess in each of said flights, said cam member being engagable with each recess.

3. The throwing dart of claim 2, wherein said retaining means comprises a notch in each flight spaced from said recess and engagable with said cam member.

4. The throwing dart of claim 1, wherein said tail portion comprises a stem portion and a sleeve axially movable along said stem portion, said sleeve means comprising a first tubular portion and a conical portion, a plurality of slots in said tubular portion and a flight disposed in each of said slots.

5. A throwing dart comprising a dart body having a longitudinal axis and a tail portion, said tail portion comprising a stem portion and a sleeve axially movable along said stem portion, a plurality of flights mounted to said sleeve for radial movement relative to the axis of the dart body and cam means cooperating between said stem portion and said flights for moving said flights from retracted positions to radially outwardly extended positions in response to axial movement of said sleeve along said stem portion in a direction away from said dart body, said stem portion including a shaft, said cam means comprising a cam member mounted to said shaft and a recess in each of said flights, said cam member being engagable with each recess.

6. The throwing dart of claim 5, wherein said cam member comprises a disk having a periphery and being mounted at an end of said shaft, each recess including a cam follower edge engagable with the periphery of said disk.

7. The throwing dart of claim 5, including a notch in each flight spaced from said recess and engagable with said cam member for releasably holding the flights in their extended positions.

8. The throwing dart of claim 5, wherein said flights each have a trailing edge, a deflector mounted to said stem portion and covering at least a portion of the trailing edges of said flights for deflecting darts.

9. The throwing dart of claim 8, wherein said deflector comprises a conical or convex member mounted to said stem portion by a connecting rod.

10. The throwing dart of claim 5, wherein said cam member is disk-shaped, said sleeve comprising a first tubular portion and a conical portion slidable along said shaft, said first tubular portion having a plurality of slots for receiving a respective flight, each flight having a finger at one end thereof engagable with the conical portion of said sleeve and a recess with a cam follower edge engagable with the disk-shaped cam member such that when said sleeve is moved axially away from said dart body, said cam member engages said cam follower edges of said flights and urges said flights radially outwardly about pivot axes defined by the points of contact between the fingers and the conical portion of said sleeve.

11. The throwing dart of claim 10, including a circumferential groove in said first tubular portion and transverse slots in each of said flights, a resilient band engagable in said groove and the transverse slot in each flight for resiliently biasing said flights toward their retracted positions.

12. The throwing dart of claim 5, wherein said flights have inner edges, said cam means being engagable with the inner edges of the flights.

13. The throwing dart of claim 12, wherein said inner edge of each flight comprises a recess having a cam following edge engagable by said cam means.

14. The throwing dart of claim 5, wherein said sleeve comprises a tubular portion having a plurality of longitudinal slots formed therein, a respective flight disposed in each of said slots, said cam means including a cam member engagable with each of said flights.

15. The throwing dart of claim 5, wherein said sleeve is rotatable relative to said stem portion.

16. The throwing dart of claim 5, wherein said stem portion has a threaded connection to said dart body and through a bore in said stem portion for facilitating the threading and unthreading of said threaded connection.

17. A throwing dart comprising a dart body having a longitudinal axis and a tail portion, said tail portion comprising a stem portion and a sleeve axially movable along said stem portion, a plurality of flights mounted to said sleeve for radial movement relative to the axis of said dart body, cam means cooperating between said stem portion and said flights for moving said flights from retracted positions to radially outwardly extended positions in response to axial movement of said sleeve along said stem portion in a direction away from said dart body, said sleeve means comprising a first tubular portion and a conical portion, a plurality of slots in said tubular portion, a flight in each of said slots, and means engagable with each of said flights for resiliently biasing said flights toward the retracted positions thereof.

18. The throwing dart of claim 17, including a transverse slot in each flight and a circumferential groove in said sleeve, said resilient biasing means comprising an elastic band engagable in said transverse slots and said groove.

19. The throwing dart of claim 17, wherein each of said flights includes a finger at one end thereof, said fingers being engagable with said conical portion whereby said flights pivot about said fingers when said sleeve is moved axially relative to said shaft.

20. A throwing dart comprising a dart body having a longitudinal axis, a tail portion connected to said dart body, said tail portion comprising a plurality of flights, means for mounting said flights for axial movement relative to said axis, means responsive to axial movement of said mounting means away from the dart body for camming said flights from retracted positions adjacent said axis to radially extended, cocked positions relative to said axis, and means for resiliently biasing said flights from said radially extended, cocked positions toward said retracted positions whereby upon impact with a target said flights are released from said cocked positions and said biasing means moves said flights to and retains said flights in said retracted positions.

* * * * *